United States Patent [19]

L'Ecuyer et al.

[11] 4,105,201

[45] Aug. 8, 1978

[54] GYMNASTIC BALANCE BEAM

[76] Inventors: Camille L'Ecuyer, 651 Morin St., St. Jérôme, Quebec; Laurent Poulin, 630 11e rue, St. Georges-Ouest, Quebec, both of Canada

[21] Appl. No.: 775,790

[22] Filed: Mar. 9, 1977

[51] Int. Cl.[2] ..... A63B 1/00

[52] U.S. Cl. ..... 272/111

[58] Field of Search ..... 272/111, 62, 63, 109

[56] References Cited

U.S. PATENT DOCUMENTS

| | | | |
|---|---|---|---|
| 3,083,964 | 4/1963 | Wentzel | 272/111 |
| 3,339,920 | 9/1967 | Moritz | 272/111 |
| 3,580,568 | 5/1971 | Stone | 272/111 |

*Primary Examiner*—William R. Browne

*Attorney, Agent, or Firm*—Alan Swabey & Co.

[57] ABSTRACT

The disclosure describes a gymnastic balance beam which is provided with several standing or walking faces. The beam itself is in the form of an elongate body whose ends can be locked in various positions which are selected by axially rotating the body and fixing the ends. Each end of the elongated body includes a portion which has four flat faces with a bore in each face to receive a dowel which is positioned in each seat that receives the elongate body. The main walking section of the elongate body which is intermediate the ends thereof has as many different walking surfaces as there are positions which can be selected.

3 Claims, 7 Drawing Figures

GYMNASTIC BALANCE BEAM

This invention relates to a gymnastic balance beam. More particularly, the invention relates to an initiation horizontal gymnastic beam which is provided with several standing or walking faces resulting in improved versatility particularly for training young people.

Presently, there are basically two types of gymnastic beams which are either 4 inches or 6 inches wide. It will be obvious that these beams are not at all versatile because only one face will be used in practicing gymnastics. For example, in cross-section, the standard beam might either be rectangular or in the form of a geometrical figure in which the vertical faces are slightly rounded.

Naturally, a standard 4 inch or 6 inch beam is not necessarily suitable to everybody. On the other hand, it would be interesting to have something else than a mere flat surface on which the gymnast can exercise and practice his skill.

It is an object of the present invention to provide a horizontal beam which can be used in different position while offering a plurality of practicing surfaces.

It is another object of the present invention to provide a gymnastic balance beam with several standing or walking faces which are not necessarily flat and/or horizontal.

These and other objects of the present invention could be met by providing a gymnastic balance beam which comprises:

(a) an elongate body for horizontal mounting;

(b) said elongate body having means at both ends thereof to lock said beam in a position which is selected by axially rotating said elongate body;

(c) a main walking section intermediate said means, said main walking section having as many different walking surfaces as there are positions which can be selected.

The invention will be illustrated by means of the following drawings.

Figures 1, 2, 3, 4, 5, 6, 7:
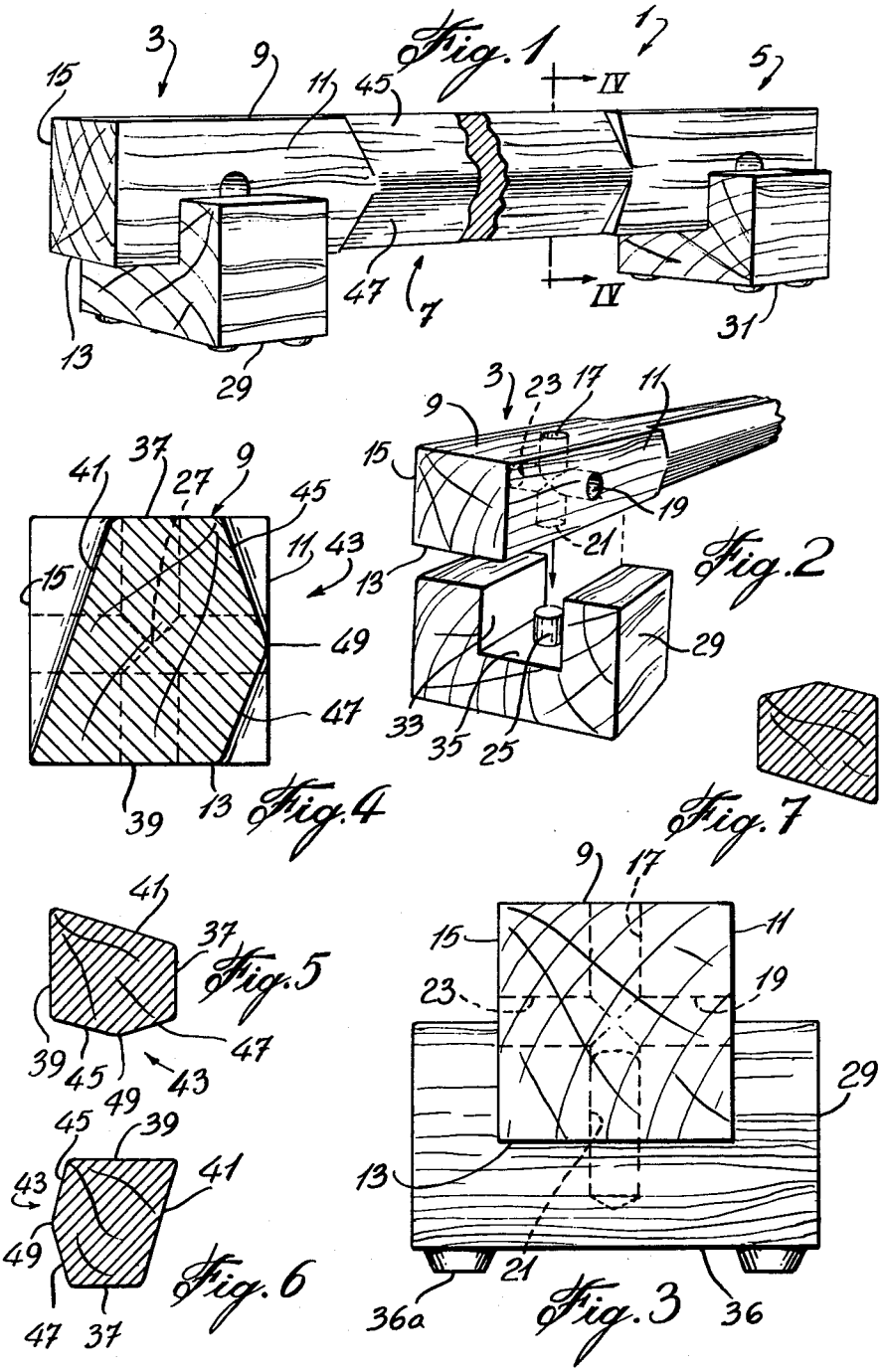
FIG. 1 is a perspective view of a gymnastic balance beam according to the invention.
FIG. 2 is a perspective view showing means of locking the balance beam in a selected position.
FIG. 3 is a view from one end of the beam illustrated in FIG. 1 showing the beam in locked position.
FIG. 4 is a cross-section taken along line IV—IV of FIG. 1.
FIG. 5 is a cross-section of the main walking section of the beam showing one position with the wider slanted face in use.
FIG. 6 is a cross-section of the main walking section of the beam showing one position with the wider flat surface in operation.
FIG. 7 is a cross-section of the main walking section of the beam showing one position with the surface formed by two merging oppositely oblique faces in operation.

Referring to the drawings, it will be seen that the gymnastic balance beam mainly comprises an elongate body 1 which is adapted for horizontal mounting. The elongate body 1 has three sections namely two end sections 3 and 5 and one main walking section 7 which is intermediate the sections 3 and 5.

Both end sections 3 and 5 are identical and for the purpose of this description, it will only be necessary that one of them be described; we have selected end section 3.

As shown and as will be evident from the drawings, end section 3 extends only a small portion of the elongate body and is square in cross-section which means that it has four flat faces 9, 11, 13 and 15. As illustrated, each flat surface 9, 11, 13 and 15 is formed with a corresponding bore 17, 19, 21 and 23. Each bore is normal to the corresponding flat surface and consequently it extends transversely into the elongate body 1. For locking purposes, the bores should be deep enough to engage a dowel 25 which will be described later. In practice, the bores should all meet at 27 as shown in FIG. 4. Practically speaking, bores 19 and 23 are the one and the same except that bore 19 is considered relative to surface 11 while bore 23 is considered relative to surface 15. The same is true with respect to bores 17 and 21 and faces 9 and 13 of the end section 3.

The gymnastic balance beam also comprises a pair of seats 29,31. Each seat is U-shaped and the recess 23 which is defined by this particular shape is dimensioned to receive one end section 3 or 5 of the elongate body in any selected position thereof.

In the bottom 35 of the seat 29 there is a dowel which projects upwardly in the manner shown in FIG. 4 and which is shaped to be inserted into anyone of the bores 17, 19, 21, 23.

Finally, for ease of handling and manipulation, the lowermost face 36 of the seat 29 has four studs 36*a*.

Turning now to the main walking section 1 of the elongate body, the latter will be seen to consist of four surfaces as particularly illustrated in FIG. 4. These four surfaces can be selected at will by the gymnast or the person practicing gymnastics.

Two of these surfaces 37 and 39 are parallel to one another and differ only in width. Surface 39 as shown is wider than surface 37.

There is a third surface 41 which connects both the parallel surfaces 37, 39 and as shown, which is wider than any one of surfaces 37 and 39. Surface 41 is oblique with respect to both parallel surfaces 37 and 39.

Finally, there is a fourth surface 43 which is formed by the merging of two oppositely oblique faces 45, 47 thus defining an apex 49. It will of course be realized that the latter will form a longitudinal sharp walking edge on the fourth surface 43 of the main walking section 7.

In the model which has been illustrated, the oblique face 47 is parallel to the slanted surface 41. Face 45 is also oblique but is oppositely incline with respect to face 47.

In operation, it will be understood that the device can be used in four basic positions as shown in FIGS. 4, 5, 6 and 7.

In the position illustrated in FIG. 4, the beam will be in use with the narrower surface 37. The beam will be locked in this position by having the ends 3, 5 received in the seats 29, 31 where the dowel 25 is inserted into a corresponding bore to prevent any rotation of the device. A person will then be in a position to walk or exercise on a very narrow surface.

Rotating the beam clockwise by 90° which can be obtained by lifting the beam from its locked position shown in FIG. 1, to adopt the position illustrated in FIG. 2, the wider face will adopt a slanted position as shown in FIG. 5. This should help a person to practice on a slanted surface.

Rotating it again in the same manner by 90°, the device will now be used with the middle face 39. Finally, in another refinement according to the invention, the beam is rotated another 90° which will enable a person to exercise on surface 43, especially along longitudinal edge 49. This should enable a young person to become used to work with a wire.

Otherwise, the device is self-explanatory.

We claim:

1. A gymnastic balance beam which comprises:

(a) an elongate body for horizontal mounting;

(b) said elongate body being terminated at both ends with a portion which is square in cross-section, said portion having four flat faces;

(c) a pair of seats;

(d) each said seat being U-shaped to define a recess adapted to receive both end portions of said elongate body;

(e) said elongate body having a means at both ends to lock the elongate body in a position which is selected by axially rotating said elongated body, said locking means including a bore formed in each said flat face and normal thereto to extend transversely into said elongate body;

(f) a dowel at the bottom of said recess to be inserted into one of said bores to selectively lock said beam in a plurality of positions which are selected by axially rotating said elongate body;

(g) main walking sections intermediate said square portions, said main walking sections having as many different widths of walking surfaces as there are positions which can be selected.

2. A gymnastic balance beam according to claim 1, wherein said main walking section have four different walking faces.

3. A gymnastic balance beam according to claim 2, wherein said main walking section consists of:

(a) two surfaces which are parallel to one another and which differ in width;

(b) a third surface which connects both said parallel faces and is wider than both of them, said third surface being oblique with respect to both said parallel surfaces;

(c) a fourth surface which is formed by the merging of two oppositely oblique faces which define an apex, said apex forming a longitudinal sharp walking edge on the fourth surface of said main walking section, said fourth surface connecting said two parallel surfaces.

* * * * *